US008006765B2

(12) United States Patent
Richards et al.

(10) Patent No.: US 8,006,765 B2
(45) Date of Patent: Aug. 30, 2011

(54) WELL SERVICING TOOL STORAGE SYSTEM FOR SUBSEA WELL INTERVENTION

(75) Inventors: Andrew Richards, Aberdeenshire (GB); Mark Davies, Aberdeenshire (GB)

(73) Assignee: Expro AX-S Technology Limited, Aberdeen (GB)

( * ) Notice: Subject to any disclaimer, the term of this patent is extended or adjusted under 35 U.S.C. 154(b) by 680 days.

(21) Appl. No.: 11/631,087

(22) PCT Filed: Jun. 3, 2005

(86) PCT No.: PCT/GB2005/002189

§ 371 (c)(1),
(2), (4) Date: Aug. 19, 2008

(87) PCT Pub. No.: WO2006/003362

PCT Pub. Date: Jan. 12, 2006

(65) Prior Publication Data

US 2009/0211760 A1 Aug. 27, 2009

(30) Foreign Application Priority Data

Jul. 1, 2004 (GB) ..... 0414765.8

(51) Int. Cl.
*E21B 23/00* (2006.01)

(52) U.S. Cl. ..... 166/351; 166/339; 166/341; 166/381; 166/77.1; 166/85.5; 166/241.5

(58) Field of Classification Search ..... 166/351, 166/338, 339, 341, 349, 368, 381, 385, 77.1, 166/85.1, 85.5, 241.1, 241.5
See application file for complete search history.

(56) References Cited

U.S. PATENT DOCUMENTS

| | | | | |
|---|---|---|---|---|
| 3,396,789 | A * | 8/1968 | Dean | 166/351 |
| 3,976,347 | A * | 8/1976 | Cooke et al. | 439/132 |
| 4,444,275 | A * | 4/1984 | Beynet et al. | 175/7 |
| 5,188,178 | A * | 2/1993 | Noyes | 166/310 |
| 5,433,276 | A * | 7/1995 | Martain et al. | 166/384 |
| 5,803,191 | A * | 9/1998 | Mackintosh | 175/170 |
| 6,039,122 | A * | 3/2000 | Gonzalez | 166/379 |
| 6,182,765 | B1 * | 2/2001 | Kilgore | 166/381 |
| 6,454,011 | B1 * | 9/2002 | Schempf et al. | 166/381 |
| 6,457,526 | B1 * | 10/2002 | Dailey | 166/338 |
| 6,488,093 | B2 * | 12/2002 | Moss | 166/339 |
| 6,533,032 | B1 * | 3/2003 | Seixas et al. | 166/70 |
| 6,561,276 | B2 * | 5/2003 | Hamilton | 166/339 |
| 6,659,180 | B2 * | 12/2003 | Moss | 166/339 |

(Continued)

FOREIGN PATENT DOCUMENTS

EP 1 197 631 A2 4/2002

(Continued)

*Primary Examiner* — Thomas A Beach
*Assistant Examiner* — Matthew R Buck
(74) *Attorney, Agent, or Firm* — Tarolli, Sundheim, Covell & Tummino LLP

(57) ABSTRACT

A well servicing tool storage system for subsea well intervention is disclosed which provides a tool storage means as part of the intervention system and which has a plurality of tool storage arms deployed around the tool storage means. Each arm has a clamp capable of clamping a tool, and moving the clamped tool between a stored position near the perimeter of the tool storage means, and a deployed position in the centre of the tool storage means where the tool can be made up into a wireline connection.

15 Claims, 5 Drawing Sheets

U.S. PATENT DOCUMENTS

| | | | | |
|---|---|---|---|---|
| 6,675,888 | B2 * | 1/2004 | Schempf et al. | 166/65.1 |
| 6,695,539 | B2 * | 2/2004 | McMillan et al. | 405/191 |
| 6,763,889 | B2 * | 7/2004 | Rytlewski et al. | 166/338 |
| 6,808,021 | B2 * | 10/2004 | Zimmerman et al. | 166/381 |
| 6,928,709 | B2 * | 8/2005 | McMillan et al. | 29/281.1 |
| 6,994,492 | B2 * | 2/2006 | McMillan et al. | 405/216 |
| 7,036,598 | B2 * | 5/2006 | Skjærseth et al. | 166/339 |
| 7,165,619 | B2 * | 1/2007 | Fox et al. | 166/343 |
| 7,219,737 | B2 * | 5/2007 | Kelly et al. | 166/339 |
| 7,264,057 | B2 * | 9/2007 | Rytlewski et al. | 166/338 |
| 7,331,394 | B2 * | 2/2008 | Edwards et al. | 166/339 |
| 7,578,038 | B2 * | 8/2009 | McMillan et al. | 29/428 |
| 7,735,561 | B2 * | 6/2010 | Johnson et al. | 166/339 |
| 2002/0066559 | A1 | 6/2002 | Hamilton | |
| 2003/0029618 | A1 | 2/2003 | Schempf et al. | |

FOREIGN PATENT DOCUMENTS

| | | | |
|---|---|---|---|
| EP | 1 236 859 | A2 | 9/2002 |
| EP | 1 251 598 | A1 | 10/2002 |
| WO | WO 01/33029 | A2 | 5/2001 |
| WO | WO 02/14651 | A1 | 2/2002 |
| WO | WO 2004/065757 | A2 | 8/2004 |

* cited by examiner

WELL SERVICING TOOL STORAGE SYSTEM FOR SUBSEA WELL INTERVENTION

FIELD OF THE INVENTION

The present invention relates to subsea well intervention systems, and particularly, but not exclusively, to an improved well servicing tool storage system with subsea well intervention systems.

BACKGROUND OF THE INVENTION

The applicant's co-pending International application PCT/GB2004/000138 discloses a system for the storage and deployment of wireline conveyed well intervention tooling using a subsea intervention device. The number of such tool storage systems have been disclosed such as in the applicant's above-mentioned PCT application, or in PCT application number PCT/US01/23518, but neither are optimized for storing and deploying wireline, or coil tubing in the case of PCT/US01/23518 tools using an autonomous, remote system. The aforementioned systems have some disadvantages. Firstly, in the case of PCT/GB2004/000138, it may not be possible to deploy longer rigid tools because of the geometry of getting the tool from the angled pocket into the well centreline where it has to be made up in the vertical plane, while a portion of the tool remains in the angled pocket. In the case of PCT/US01/23518, the eccentric (i.e. to the wellbore centreline) carousel system results in a badly balanced system when installing it onto a subsea Christmas tree using an ROV assistance, especially given the wall thickness needed for the carousel to withstand internal oil pressure.

SUMMARY OF THE INVENTION

It is an object of the present invention to provide an improved well servicing tool storage system for subsea well intervention, which obviates or mitigates at least I one of the aforementioned disadvantages.

This is achieved in its broadest concept by providing a tool storage means as part of the intervention system and deploying a plurality of tool storage arms around the tool storage means, each arm having a clamp capable of clamping a tool, and moving the tool between a stored position near the perimeter of the tool storage means, and a deployed position in the centre of the tool storage means whereby the tool can be made up into a wireline connection.

In accordance with the first aspect of the present invention there is provided a well intervention system for storage and deployment of wireline tooling, the system comprising:

a tool storage chamber having a plurality of tool storage clamping means disposed about the periphery of the chamber, each tool storage clamping means being capable of retaining a tool in a storage position, and being moveable from the storage position to a deployment position where the tool may be coupled and decoupled to a connection tool from above, said tool storage means having a storage clamp at its free end, said clamp being moveable between a closed position for retaining tool in said stored position and for holding the tool as it is moved between the deployment position and the storage position, and an open position when the tool is in the deployment position to allow the tool to be coupled and uncoupled to said connection tool.

Preferably the storage clamp has a fully closed position and a partially closed position, the clamp being moveable to the partially closed position when retrieving the tool from the well source to locate the tool in the correct position for full recovery. Once the tool is located in the correct position the clamp is fully closed so that the connection means can be released and the tool disconnected and returned to the storage position by the tool storage clamping means.

Preferably also the storage chamber is cylindrical, said plurality of tool storage clamp means are disposed around the circumference of a cylindrical storage chamber and the clamping means are moveable radially.

Preferably eight tool storage and clamping means are disposed around the periphery of the storage chamber. Alternatively any number of tools up to twelve can be stored in the chamber.

Advantageously each clamp has two jaws which are moveable between open and closed or partially closed positions, the jaws being hydraulically or electrically actuatable.

Conveniently each clamp includes a fixed portion and a moveable portion, the moveable portion comprising a pair of jaws which are moveable towards each other to clamp the tool, and away from each other to release the tool, said clamp actuating means being located within the fixed portion.

According to a further aspect of the present invention there is provided a method in deploying a tool from a tool storage system for subsea well intervention in a subsea well, said method comprising:

storing a plurality of oil intervention tools within a tool storage chamber so that the tools are substantially vertically aligned within said chamber when in said storage position;

selecting a tool for deployment;

moving said selected tool transversely to a tool deployment position, said tool deployment position being substantially coaxial with said subsea well;

coupling a connection tool from above to the top of the selected tool; and releasing the selected tool and deploying the selected tool in said well.

Preferably the method includes arranging the centre line of the storage chamber to be coaxial with the subsea well, and radially moving the tools between the storage position and the deployment position in said centre line.

According to a further aspect of the present invention there is provided a method of storing a tool used for subsea well intervention within a well storage system after the tool has been deployed in the well, said method comprising:

returning the deployed tool to a first position within the tool storage chamber, said first position being substantially coaxial with said subsea well;

engaging the deployed tool in a second position, said second position still being coaxial with said subsea well;

clamping said tool in the second position; and decoupling the tool from a wireline connection system and moving the decoupled tool from the deployed position to a tool storage position.

Preferably the method includes arranging the centre line of the storage chamber to be coaxial with the subsea well, and radially moving the tools between the storage position and the deployment position in said centre line.

According to a further aspect of the present invention there is provided a tool storage and deployment mechanism for use with a subsea well intervention system, said tool storage and deployment mechanism comprising:

tool storage clamping means being capable of retaining a tool in a storage position, and being moveable from the storage position to a deployment position where the tool may be coupled and decoupled to a connection tool from above, said tool storage means having a storage clamp at its free end, said clamp being moveable between a closed position for retaining tool in said stored position and for holding the tool as it is moved between the deployment position and the storage position, and an open position when the tool is in the deployment position to allow the tool to be coupled and uncoupled to said connection tool.

Preferably the tool storage and deployment mechanism has eight clamping means disposed about the periphery of the tool storage chamber. Alternatively there may be one to twelve clamping means.

Conveniently each clamp has two jaws and the jaws are electrically or hydraulically actuatable.

According to a further aspect of the present invention there is provided a connection mechanism for coupling a wireline to a wireline tool for deployment in a wireline intervention system, said connection mechanism comprising:

a first male portion having a plurality of circumferentially disposed axially aligned collet fingers which are radially moveable;

a female receptacle disposed at the top of said wireline tool, said female receptacle having an internal profile for receiving said collet fingers; and an electrical connector mechanism disposed within said male mechanism and said collet fingers, said electrical connector mechanism being actuatable to move between a stored position after the collet fingers are engaged in said receptacle and a connecting position after engagement, whereby after actuation, the collet fingers are locked by said connecter mechanism to said profile to prevent release of the male and female members, and to provide electrical connection between the wireline and wireline tool.

BRIEF DESCRIPTION OF THE DRAWINGS

These and other aspects of the present invention will become apparent from the following description when taken in combination with the accompanying drawings and which.

DESCRIPTION OF EXAMPLE EMBODIMENTS

Figure 1:
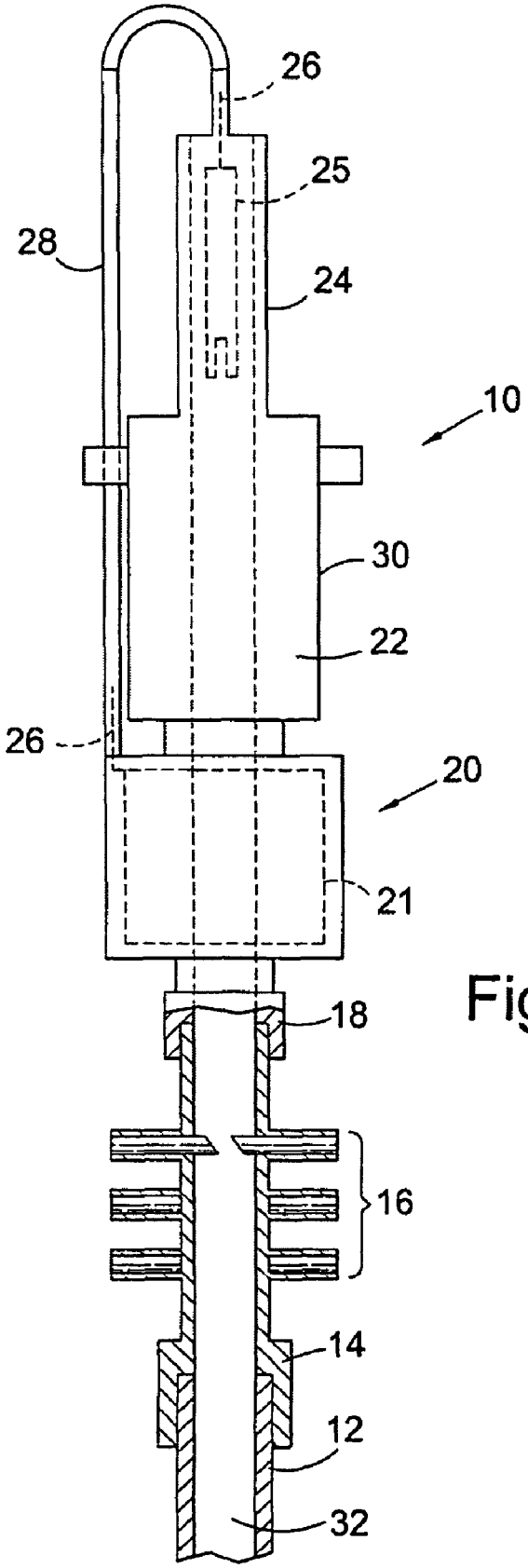
FIG. 1 is a diagrammatic view of a subsea intervention system in accordance with an embodiment of the present invention depicting the main components of the intervention system disposed on top of a subsea Christmas tree.

Reference is first made to FIG. 1 of the drawings which depicts a typical autonomous subsea well intervention system in accordance with an embodiment of the present invention, and generally indicated by reference numeral 10. The system is shown installed on top of a subsea Christmas tree 12. The principal components of the intervention system are: a main system connector 14 which interfaces with the Christmas tree 12, a Blow-Out Preventer 16 (BOP) or flow control valves to affect closure of well and isolation from the environment in an emergency, or in the event having to remove the upper package from the intervention system; an intermediate connector 18 coupled to the top of the BOP connector; a housing 20 containing a coaxial wireline winch 21 (shown in broken outline) coupled to the top of the intermediate connector 4, and disposed axially around the wellbore; a tool storage system 22 as will be later described in detail, and a lubricator or riser section 24 containing a connection tool 25 (in broken outline) for connecting a wire 26 from the wireline winch 21 to the tool (not shown) on the storage system via a wireline lubricator 28.

a housing 20 containing a coaxial wireline winch 21 (shown in broken outline) coupled to the top of the intermediate connector 18, and disposed axially around the wellbore; a tool storage system 22 as will be later described in detail, and a lubricator or riser section 24 containing a connection tool 25 (in broken outline) for connecting a wire 26 from the wireline winch 21 to the tool (not shown) on the storage system via a wireline lubricator 28.

Figure 2:
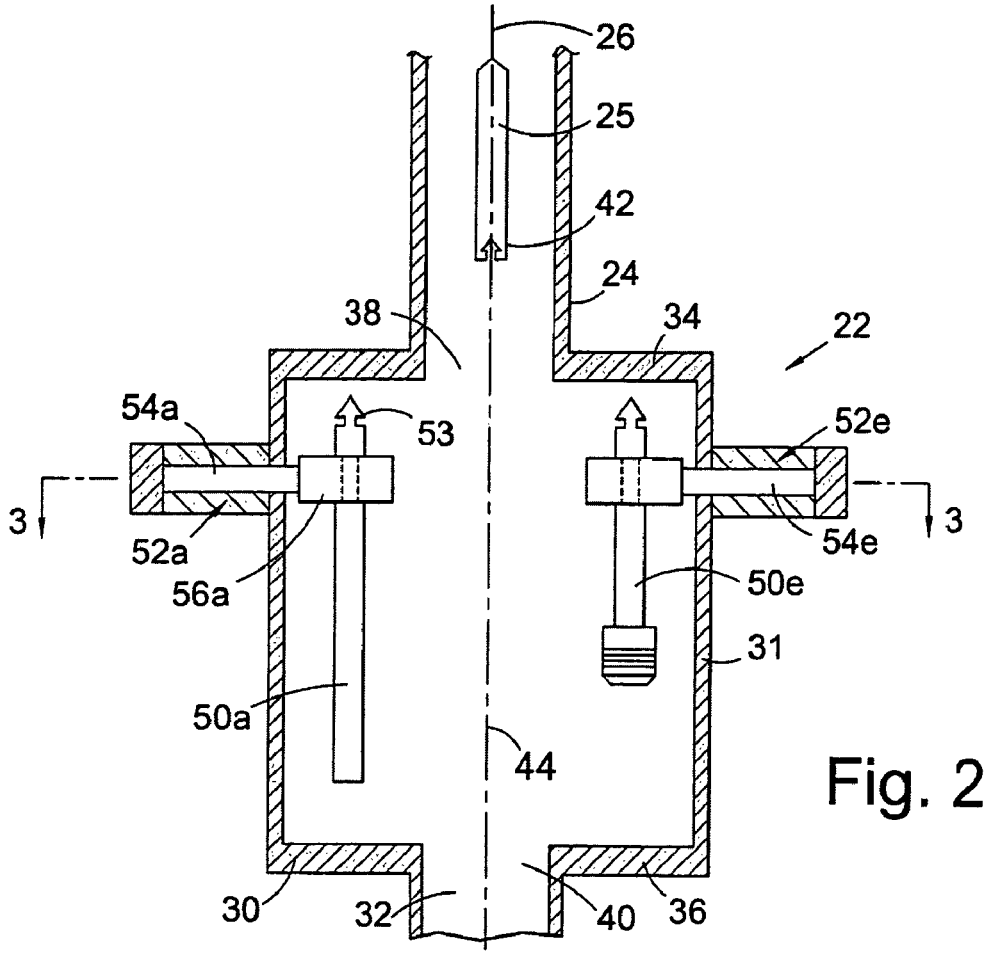
FIG. 2 is an enlarged side view of the tool storage and deployment chamber showing two separate tools stored in the chamber for deployment into the wellbore.
Figure 3:
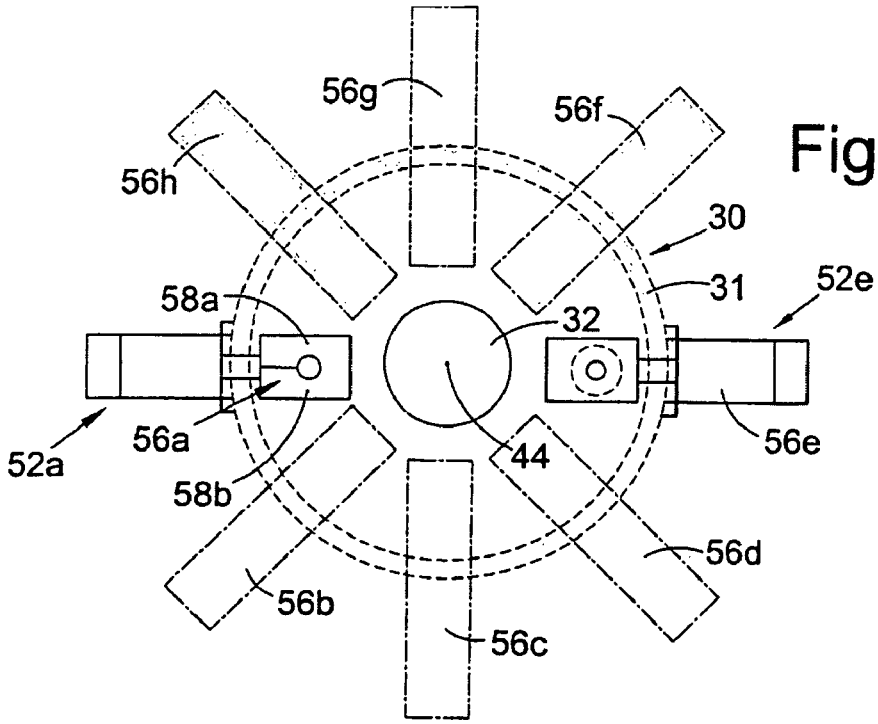
FIG. 3 is a cross-sectional view taken in the lines 3:3 in FIG. 2, and depicts how the tool storage clamps are radially disposed around the circumference tool storage chamber.

Reference is now made to FIGS. 2 and 3 of the drawings which depict enlarged diagrammatic side and plan views of the tool storage unit 20 shown in FIG. 1. It will be seen that the storage system 22 comprises a cylindrical chamber 30, the cylindrical wall 31 (and end walls) of which are designed to withstand the internal pressure of the well when the chamber 30 is open to the wellbore 32 (best seen in FIG. 1). The cylindrical chamber 30 is concentric with the wellbore 32, as best seen in FIG. 3. The chamber 30 has top and bottom faces 34 and 36, and has apertures 38 and 40 in these faces respectively, to allow the wireline 26 to run into the wellbore 32 from the lubricator riser section 24 above the cylindrical storage system 30.

The wireline 26 from the wireline winch 21 is connected to the wireline connection tool 25, which is normally disposed in the lubricator section 24 when not being used to deploy tools into the well. The wireline connection tool has at its lower end 25, an automatic connection device 42 designed to connect or disconnect from wireline tools held in the storage chamber 30, which will be later described in detail.

The wireline tools generally indicated by reference numerals 50*a* to 50*h* are held in the chamber 30 in storage clamping units 52*a* to 52*h*. As best seen in FIG. 3, eight clamping units are disposed circumferentially around the tool storage chamber 30, and two of the clamping units 52*a* and 52*e* are shown in solid outline. In the position shown in FIGS. 2 and 3, the clamping units are holding the tools in the storage position, i.e. away from the wellbore centre line and near the wall 31 of the chamber 30.

The structure and operation of one clamping unit 52*a* will be described in detail, although it will be understood that the structure and operation of all clamping units is identical.

Referring again to FIG. 2 of the drawings, it will be seen that the clamping unit 52*a* retains the wireline tool 50*a* in the vertical position near to the periphery of the storage unit 30. The storage clamping unit 52*a* comprises a hydraulically actuatable ram 54*a*, at the end of which is a clamp 56*a*. Actuation of the clamping unit 52*a*causes the ram 54*a* to move radially between the stored position shown in FIG. 2 and the deployed position shown in FIG. 4, where the wireline tool is disposed on the well centre line 44.

Figure 4:
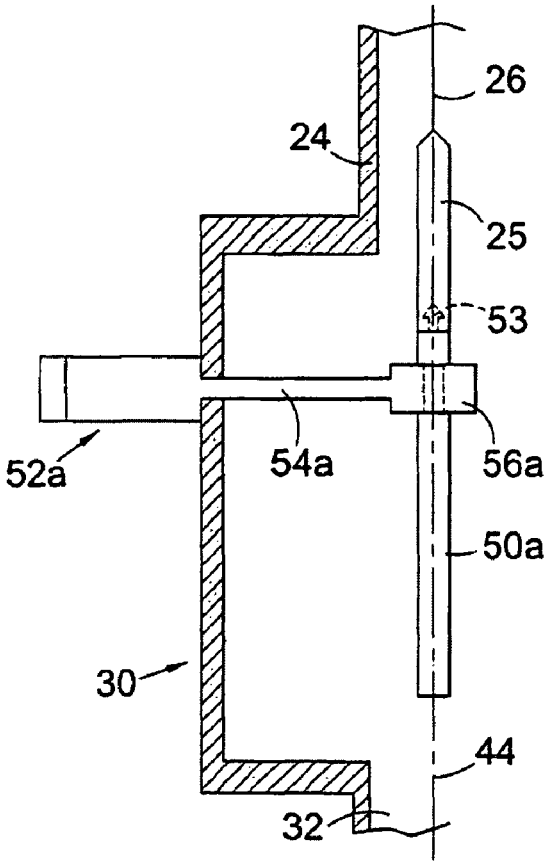
FIG. 4 is a view similar to part of FIG. 2, but showing the tool in a deployed position and made up onto the selected wireline connection tool ready for deployment or recovery.

When the tool is selected for use in the intervention system, for example, in this case tool 50*a*, an appropriate signal is sent to the clamping storage means 52*a*, such that the ram or hydraulic piston is actuated to move the clamping unit 52*a* from a position shown in FIG. 2 radially inwards until the tool 50*a* and clamping unit 56*a* are on the tool centre line 44 as shown in FIG. 4. The position shown in FIG. 4 is a deployment position. Once the wireline tool is in the deployment position the winch 21 is actuated to lower the connection tool 25 from the position shown in FIG. 2 to connect with the top 53 of the wireline tool 50*a* held in the clamp 56*a* on the wellbore centre line in FIG. 4 as will be later described in detail.

Once the connection is made as shown on FIG. 4 and the wireline tool 50*a* is securely held by the connection tool 25, the clamp 56a is ready to be released.

Figure 5:
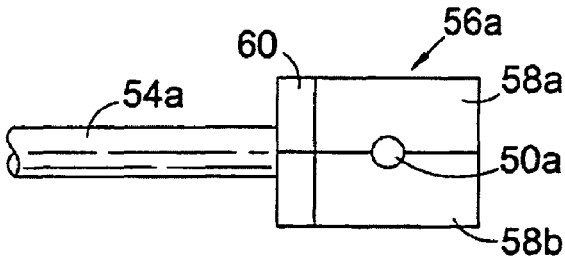
FIG. 5 depicts an enlarged plan view of a clamp used to retain wireline tools, the clamp being shown in a closed position.
Figure 6:
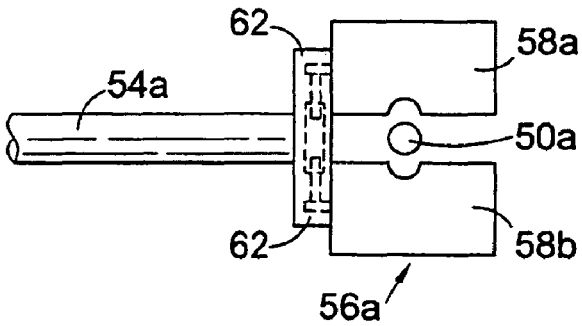
FIG. 6 is a view similar to FIG. 5, but with the clamps shown in the open position.

Reference is now made to FIGS. 5 and 6 of the drawings, which depict the clamp 56*a* in greater detail. The clamp 56*a* consists of two clamp jaws 58*a* and 58*b* which are hydraulically moveable towards and away from each other. In FIG. 5 jaws 58*a* and 58*b* are shown closed, and in FIG. 6 the jaws 56*a* and 56*b* are shown separated. Movement of the jaws is achieved by means of a hydraulic actuator 60, which is shown in broken outline in clamp support 62.

When in the position shown in FIG. 4 the hydraulic actuator 62 is activated to open the jaws to the position shown in FIG. 6. When in this position the hydraulic ram 54*a* is actuated to be withdrawn from the centre line position 44 shown in FIG. 4 back to the storage position shown in FIG. 2. This allows the wireline deployment full and unfettered access to the wellbore 32, and the selected well servicing tool 50*a* can then be lowered into the wellbore 32 by the wireline 26.

Once the tool has completed its operation it requires to be retrieved and returned to the storage position. In order to recover the wireline tool into the storage position as shown in FIG. 2, the wireline tool connector and wireline tool 50*a* assembly is pulled by the wireline winch 21 back into the lubricator riser section 24, so that the wireline tool 50*a* can be relocated within the storage section 30.

Figure 7:
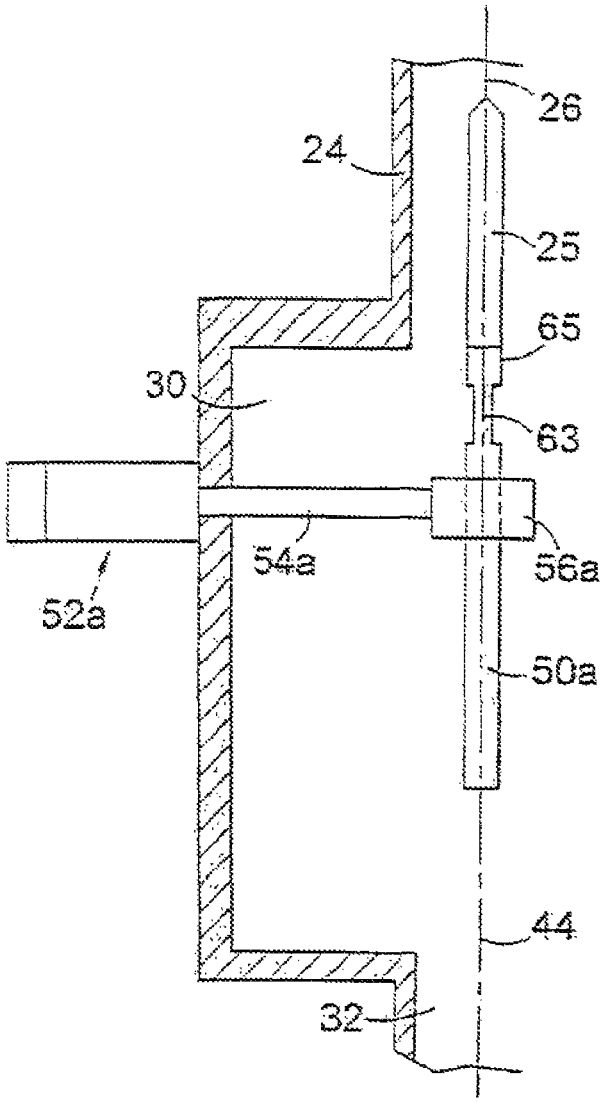
FIG. 7 is a view similar to FIG. 4, but depicts the initial position of the clamping arrangement of the wireline tool after the wireline has pulled the tool back into said chamber but prior to the movement of the tool to the stored position.

FIG. 7 depicts the initial position of the ram and clamp arrangement on the wireline tool assembly 25,50*a*, after the wireline winch 21 has pulled the wireline tool 50*a* back into the lubricator riser, and prior to the recovery of the tool 50*a* into the tool storage system 30.

The wireline tool 50*a* attached to the wireline 26 through the connection tool 25 is pulled back into the lubricator riser 24 so that a profile 63 in the wireline tool 50*a* that is designed to fit into the clamp 56*a*, is disposed above the clamp 56*a*. The hydraulic ram 54*a* is then activated so as to move the clamp from the storage position shown in FIG. 2, and towards the wireline tool assembly which is now on the wellbore centre line 44. Prior to the clamp 56*a* reaching the wireline tool 58*a*, the jaws 58*a*,58*b* of the clamp 56*a* are open to the fullest extent to allow the clamp to move either side of the wireline tool 50*a* to be recovered as the clamp 56*a* is further advanced by the ram 54*a*. The jaws 58*a*,58*b* of the clamp 56*a* are then closed to a position (partially closed) that allows most of the length of the body of the tool a to move through the partially closed jaws 58*a*, 58*b*, but does not allow a portion of increased diameter, known as a no-go 65, on the body of the wireline tool 50*a* to move through the partially closed jaws 58*a*,58*b*.

Figure 8:
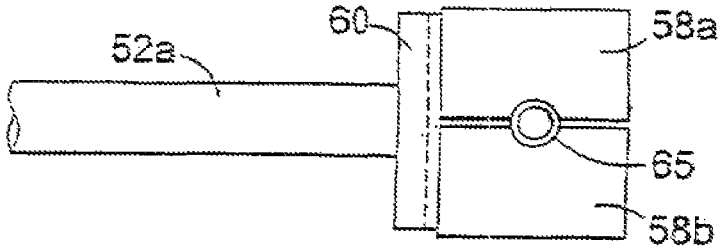
FIG. 8 shows the clamp jaws in the partially closed position with the wireline tool no-go sitting on top of the clamp jaws, and FIGS. 9 (*a*), (*b*) and (*c*) depict various stages in the connection make-up between the wireline connection tool and the wireline tool with FIG. 9(*a*) depicting the tools prior to connection, with FIG. 9(*b*) depicting the tools made up, but not locked, and FIG. 9(*c*) depicting the made up tools in a mechanically locked position and electrically connected.

The wireline winch 21 is now actuated to lower the wireline 26 attached connection tool 25 and the wireline tool 50*a* until the no-go 65 lands on top of the clamp jaws 58*a*, 58*b*. Reference is again made to FIG. 8 of the drawing which depicts the clamp jaws in the partially closed position, with the wireline tool no-go 65 sitting on top of the clamp jaws 58*a*,58*b*. With the wireline tool 50*a* in the correct position for recovery, the clamp jaws 58*a*,58*b* are then fully closed onto the profile 63 to hold the tool firmly and ready for recovery. The connector tool 25 is then energised, as will be later described, to release the connection between the connector tool 25 and the wireline tool 50*a*, allowing the wireline winch 21 to pull the connector tool 25 back into the lubricator riser 24, with the wireline tool 50*a* now firmly held in the clamp system 56*a*. With the wireline and connector tool 44 now clear of the top of the wireline tool 50*a*, the ram 52*a* is then actuated so as to retrieve the clamp 56*a* with a wireline tool 50*a*, and the jaws 58*a*,58*b* back into the storage position as shown in FIG. 2.

It will be understood that the deployment and retrieving arrangement can be repeated for any other tool held in the tool storage system such as tool 50*e*.

Figure 9A:
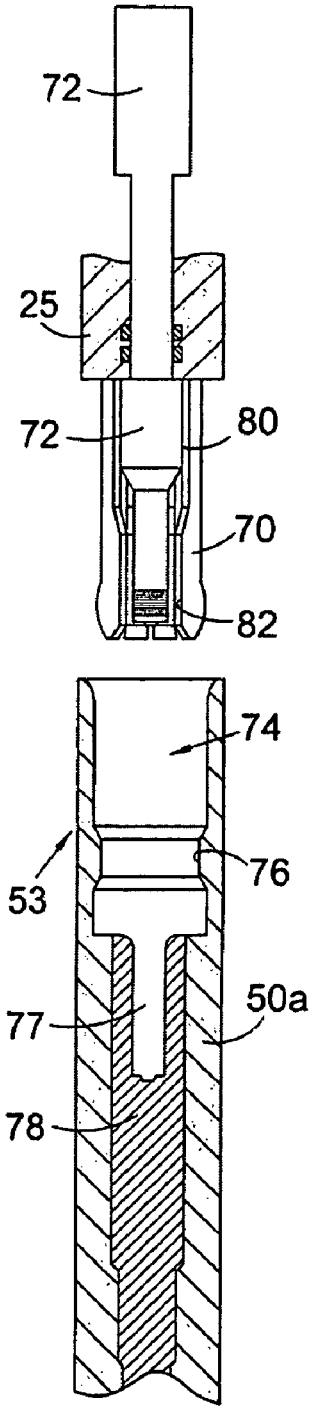
Figure 9B:
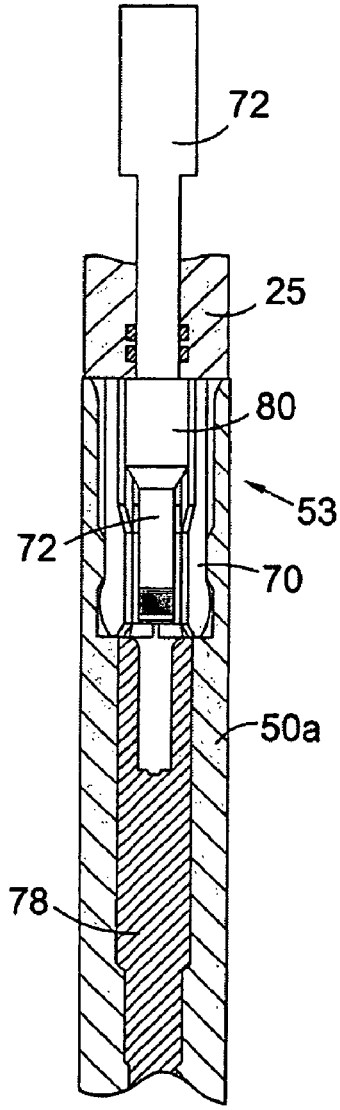
Figure 9C:
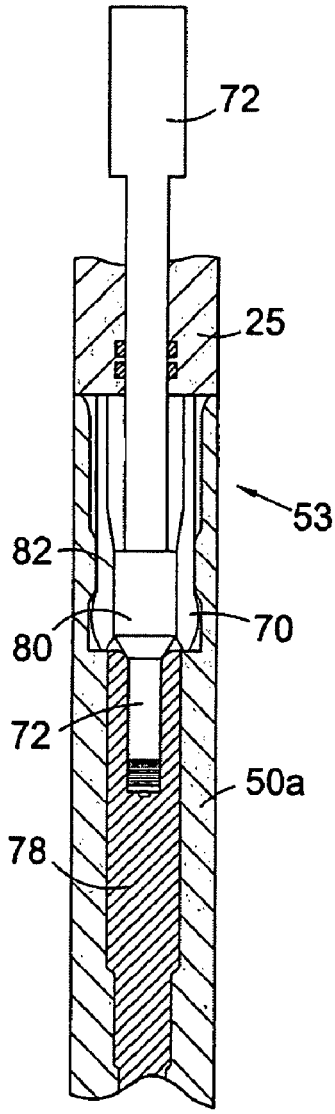

Reference is now made to FIGS. 9*a*, 9*b* and 9*c* of the drawings, which depicts the connection assembly which operates between the connector 25 and each of the wireline tools 50*a* to 50*h*. It will be understood that the tool connector system forms an integral part of the subsea intervention system for the deployment of the wireline tools, and the connection provides an electro/mechanical junction between various elements of a wireline tool string, which facilitates multiple connect/disconnect operations.

The connection tool 25 has a lower section which comprises a number of circumferentially arranged collet fingers 70, which define an aperture in which is located a moveable, electrical connection ram 72. This part is referred to as the "male part" of the tool 25. Referring to FIG. 9*a*, the top part of the tool 50*a* has a female receptacle 74 which has an interior profile generally indicated by reference numeral 76, which opens via a recess 77 to an electrical connector 78. In the positions shown in FIG. 9*a* the two parts are shown separated.

In FIG. 9*b* the connection tool 25 is lowered so that the collet fingers 70 are inserted into and engage with the receptacle 74; the collet fingers being slightly spring-loaded, so that they deform inwardly and then engage with the profile 76, as best seen in FIG. 9*b*. In this position the electrical connector ram 72 is still retained within the envelope of the collet fingers, and in this position the connector 25 can simply be retrieved back into the lubricator unit 24. The electrical connection ram 72 is driven into the recess 77 within tool 50*a*, to achieve the necessary electrical continuity connector 78. When this item is fully forward as shown in FIG. 9*c*, the wider portion 80 of the electrical connector abuts the inner surfaces 82 of the collet fingers, and locks the collet fingers 70 into the profile 76 of the female receptacle 74, and prevents the connection tool 25 from retracting and disengaging from the wireline tool 50*a*. In this position the tool 50*a* is fully locked to the connection tool 25 and the clamps 52*a* can be released as described above, and the tool 50*a*deployed into the well for intervention.

Following make up, the electrical continuity and a simple overpull test is applied via the wireline prior to the release of the tool string into the wellbore, to ensure that the connection is electrically and mechanically secure.

The disconnection process is the reverse of the make up sequence, with additional checks being made to ensure that the desired operations have occurred before proceeding. Thus the electrical connection unit is fully retracted using a linear actuation mechanism so that that arrangement as shown in FIG. 9*b* is repeated, but in reverse. Electrical continuity is then checked across the junction to ensure that the electrical connection item has retracted.

The wireline 21 is actuated so that a force to the wireline is effected to 'snap' the collet fingers 70 out of the female receptacle 74, so that the connection unit 25 is separated from the tool 50*a*, as shown in FIG. 9*b*, and the two parts are then separated, and the tool 50*a* can be returned to the storage position and the subsequent tools can then be deployed in the manner as described above.

It will be understood that various modifications may be made to the embodiment hereinbefore described without departing from the scope of the invention. For example, it will be understood that the jaws of each clamp could be activated using electrical motors and screw threads on the fixed part of the clamp to provide the lateral motion of the jaws. Furthermore, a different number of tools can be disposed around the periphery of the tool storage unit. Furthermore, clamps could be moved between the tool centre line and the storage position using an electric motor or screw arrangement, or a mechanical lead screw.

Advantages of the new system include: less complexity than equivalent tool selection systems since the tool is moved in only one dimension for make-up, and that dimension is radial. The lateral extent of the radial movement can be easily and readily controlled by limiters and confirmed by simple positional instrumentation.

Make-up certainty is increased as the lateral position (i.e. tool centre-line coincides with well bore centre-line) is controlled as above, and the tool is held vertically in the clamps.

The system is compact and of (relatively low weight)—there are attractive attributes when deploying such a system from a floating vessel.

Tool configurations held in the system can be easily varied for each type of tree or well operation, as can the number of tools "loaded" into the system.

The invention claimed is:

1. A well intervention system for storage and deployment of wellbore tooling, the system comprising:

a tool storage chamber configured to accommodate a plurality of wellbore tools;

a plurality of tool storage clamping units disposed about the periphery of the tool storage chamber, wherein each tool storage clamping unit is used to retain a respective tool in a storage position, and move said tool transversely from the storage position towards a centre region of the tool storage chamber to a deployment position where the tool is coupled and decoupled to a connection tool from above, wherein each tool storage clamping unit has a storage clamp at its free end, said storage clamp being moveable between a closed position for retaining a tool in said storage position and for holding the tool as it is moved between the storage position and the deployment position and while the tool is coupled to the connection tool, and an open position when the tool is in the deployment position and coupled to said connection tool for deployment in a subsea well.

2. A system as claimed in claim 1 wherein the storage clamp has a fully closed position and a partially closed position, the clamp being moveable to the partially closed position when retrieving the tool from an associated well source to locate the tool in the correct position for full recovery.

3. A system as claimed in claim 1 wherein the tool storage chamber is cylindrical and said plurality of tool storage clamping units are disposed around the circumference of the cylindrical storage chamber and the clamping units are moveable radially.

4. A system as claimed in claim 1 wherein eight tool storage clamping units are disposed around the periphery of the tool storage chamber.

5. A system as claimed in claim 1 wherein any number of tools up to twelve are stored in the tool storage chamber.

6. A system as claimed in claim 1 wherein each storage clamp has two jaws which are moveable between open and closed or partially closed positions, the jaws being hydraulically or electrically actuatable by a clamp actuator arrangement.

7. A system as claimed in claim 6 wherein each storage clamp includes a fixed portion and a moveable portion, the moveable portion comprising a pair of jaws which are moveable towards each other to clamp the tool, and away from each other to release the tool, said clamp actuator arrangement being located within the fixed portion.

8. A system as claimed in claim 1, wherein each tool storage clamping unit comprises a linear ram configured to be actuated to move a respective tool linearly between the storage and deployment positions.

9. A system as claimed in claim 1 wherein each of said tool storage clamping units is capable of moving the respective tool relative to said tool storage chamber from the stored position to the deployment position.

10. A system as claimed in claim 1 wherein each of said tool storage clamping units independently moveable.

11. A method for deploying a tool from a tool storage system for subsea well intervention in a subsea well, said method comprising:

storing a plurality of wellbore tools within a tool storage chamber in a storage position about the periphery of the tool storage chamber;

selecting a tool for deployment;

moving said selected tool transversely from the storage position towards a centre region of the tool storage chamber to a tool deployment position, said tool deployment position being substantially coaxial with said subsea well;

coupling a connection tool from above to the top of the selected tool; and releasing the selected tool and deploying the selected tool in said well.

12. A method as claimed in claim 11 wherein the method includes arranging the centre line of the storage chamber to be coaxial with the subsea well, and radially moving the tools between the storage position and the deployment position in said centre line.

13. A method as claimed in claim 11 wherein the step of moving said selected tool comprises moving said selected tool along a linear path from the storage position to the tool deployment position.

14. A method for storing a tool used for subsea well intervention within a well storage system after the tool has been deployed in the well, said method comprising:

returning the deployed tool to a first position within a tool storage chamber, said first position being substantially coaxial with said subsea well and located within the central region of the tool storage chamber;

engaging the deployed tool in a second position, said second position still being coaxial with said subsea well;

clamping said tool in the second position; and decoupling the tool from a connection system and moving the decoupled tool transversely away from the centre region of the tool storage chamber to a tool storage position about the periphery of the tool storage chamber.

15. A method as claimed in claim 14 wherein the method includes arranging the centre line of the storage chamber to be coaxial with the subsea well, and radially moving the tools between the storage position and the deployment position in said centre line.

* * * * *